US005498827A

United States Patent [19]

Khan et al.

[11] Patent Number: 5,498,827

[45] Date of Patent: Mar. 12, 1996

[54] HYDROTHERMAL TREATMENT AND PARTIAL OXIDATION OF PLASTIC MATERIALS

[75] Inventors: Motasimur R. Khan, Wappinger Falls; Christine C. Albert, Peekskill; Stephen J. DeCanio, Montgomery, all of N.Y.

[73] Assignee: Texaco Inc., White Plains, N.Y.

[21] Appl. No.: 131,366

[22] Filed: Oct. 4, 1993

[51] Int. Cl.[6] ..... A62D 3/00

[52] U.S. Cl. ..... 588/213; 588/216; 588/220; 588/226

[58] Field of Search ..... 588/213, 216, 588/220, 226; 210/770

[56] References Cited

U.S. PATENT DOCUMENTS 5,188,739 2/1993 Khan et al. ..... 210/770
5,271,340 12/1993 Whitney ..... 110/346

*Primary Examiner*—Gary P. Straub

*Attorney, Agent, or Firm*—George J. Darsa; Kenneth R. Priem; Jeffrey M. Greenman

[57] ABSTRACT

A process for upgrading plastic material containing inorganic filler or reinforcement material for use as feedstock in partial oxidation gas generator for the production of raw synthesis gas, fuel gas, or reducing gas. The plastic material is granulated and mixed with water to produce the plastic sludge. The plastic sludge is preheated at a temperature in the range of about 350° F. to 475° F. in the absence of air in a closed system. The preheated plastic sludge is then hydrothermally treated at a temperature in the range of about 450° F. to 650° F. at a pressure in the range of about 100 to 1200 psig and above the vapor pressure of water at that temperature. The hydrothermally treated plastic sludge is cooled, degassed, and mixed with ground solid carbonaceous fuel, e.g., coal and water, to produce a pumpable aqueous slurry having a solids content in the range of about 40 to 60 wt. %. The pumpable aqueous slurry is then reacted by partial oxidation to produce said synthesis gas, fuel gas, or reducing gas. In one embodiment, a portion of coal is mixed with the plastic sludge prior to the aforesaid preheating and hydrothermal steps.

12 Claims, No Drawings

HYDROTHERMAL TREATMENT AND PARTIAL OXIDATION OF PLASTIC MATERIALS

FIELD OF THE INVENTION

This invention relates to an environmentally safe method for disposing of scrap plastic materials. More particularly, it pertains to a process for upgrading scrap plastic materials to produce a pumpable slurry of hydrocarbonaceous liquid solvent and hydrothermally treated scrap solid carbonaceous plastic-containing material and introducing said slurry into a partial oxidation gasifier for the production of synthesis gas, reducing gas, or fuel gas.

Scrap plastics are solid organic polymers and are available in such forms as sheets, extruded shapes, moldings, reinforced plastics, laminates, and foamed plastics. About 60 billion pounds of plastics are sold in the United States each year. For example, automobiles are increasingly being manufactured containing more plastic parts. A large part of these plastic materials wind up as scrap plastics in landfills. Although plastics account for only a small portion of the waste dumped in landfills i.e. about 7 wt. % and about 20 percent by volume, burying them is getting increasingly difficult. The cost of landfilling this material in 1993 is between $12 to $100 per ton (excluding shipping costs); and this cost is rising. Landfills are not universally viewed as an acceptable, or even a tolerable option for the disposal of plastic materials. Due to the combined effects of the unpopularity of existing facilities and the need for land to allow normal growth of populations, new landfills have been all but banned in many parts of the world. Existing facilities are also facing finite limits as to how long they may continue to function. Also, toxic wastes from buried plastics seep into and pollute underground streams which are commonly the source of our fresh water. Further, on-site burning or incineration which are alternative disposal methods are in disfavor because they generate heavy air pollution from noxious gases and soot. With respect to recycling plastics, it has been economically feasible to recycle only about 1 wt. % of the scrap plastics. It is obvious from the aforesaid that the disposal of scrap plastics is one of the nation's most pressing environmental problems.

Advantageously by the subject environmentally acceptable process, a wide range of plastic feedstocks are partially liquefied for volume reduction and comparatively low cost disposal by partial oxidation. Useful synthesis gas, reducing gas or fuel gas is produced. Further, the relatively medium heating value of the plastic material e.g. greater than about 3,000 Btu/lb is made available for heating internal process streams or producing by-product hot water or steam.

SUMMARY OF THE INVENTION

This invention relates to an environmentally acceptable process for the partial oxidation of a pumpable aqueous slurry of hydrothermally treated solid carbonaceous plastic material containing inorganic filler or reinforcement material; wherein raw synthesis gas, reducing gas, or fuel gas is produced by said process comprising the steps of:

(1) granulating plastic material containing inorganic filler or reinforcement material;

(2) mixing the granulated plastic from (1) with supplemental water to produce a plastic sludge having a solids content in the range of about 60 to 80 wt. %;

(3) preheating the plastic sludge from (2) for a period in the range of about 5 minutes to 1 hour at a temperature in the range of about 350° F. to 475° F. in the absence of air in a closed system;

(4) hydrothermally treating the preheated plastic sludge from (3) in a closed vessel in the absence of air for a residence time in the range of about 15 to 90 minutes, a temperature in the range of about 450° F. to 650° F., a pressure in the range of about 100 to 1200 psig and above the vapor pressure of water at that temperature;

(5) cooling the hydrothermally treated plastic sludge from (4) to a temperature in the range of about 100° F. to 200° F., and separating from said plastic sludge at least one gas from the group consisting of $CO_2$, CO, $H_2S$, $NH_3$, and light hydrocarbon gases;

(6) mixing the cooled plastic sludge from (5) with ground solid carbonaceous fuel and water to produce a pumpable aqueous slurry having a solids content in the range of about 40 to 60 wt. %, and a weight ratio of solid carbonaceous fuel to plastic sludge in the range of about 1 to 5 parts by wt. of solid carbonaceous fuel for each part by weight of plastic sludge; and (7) reacting by partial oxidation with a free-oxygen containing gas said pumpable aqueous slurry from (6) to produce raw synthesis gas, fuel gas, or reducing gas.

In another embodiment, the raw synthesis gas, fuel gas, or reducing gas is introduced into a conventional gas purification zone to remove gaseous impurities.

DESCRIPTION OF THE INVENTION

Scrap plastics are disposed of by the process of the subject invention without polluting the nation's environment. Simultaneously, useful by-product nonpolluting synthesis gas, reducing gas, fuel gas and nonhazardous slag are produced.

The scrap plastic materials which are processed as described herein into a pumpable slurry fuel feed for a partial oxidation gas generator include at least one solid carbonaceous thermoplastic or thermosetting material that contains associated inorganic matter e.g. fillers and reinforcement material. Sulfur is also commonly found in scrap plastics. Scrap plastic materials may be derived from obsolete equipment, household containers, packaging, industrial sources and junked automobiles. The mixture of plastics is of varying age and composition. With the presence of varying amounts of incombustible inorganic matter compounded in the plastic as fillers, catalysts, pigments and reinforcing agents, recovery of the plastic material is generally impractical. Further, complete combustion can release toxic-noxious components including volatile metals and hydrogen halides. Associated inorganic matter in the scrap solid carbonaceous plastic includes fillers such as titania, talc, clays, alumina, barium sulfate and carbonates. Catalysts and accelerators for thermosetting plastics include tin compounds for polyurethanes, and cobalt and manganese compounds for polyesters. Dyes and pigments such as compounds of cadmium, chromium, cobalt, and copper; nonferrous metals such as aluminum and copper in plastic coated wire cuttings; metal films; woven and nonwoven fiber glass, graphite, and boron reinforcing agents; steel, brass, and nickel metal inserts; and lead compounds from plastic automotive batteries. Other heavy metals e.g. cadmium, arsenic, barium, chromium, selenium, and mercury may be also present. The inorganic constituents are present in the solid carbonaceous plastic-containing material in the amount of about a trace amount to about 60 wt. % of said solid carbonaceous plastic-containing material, such as about 1 to 20 wt. %. The scrap plastic material may be in the form of sheets, extruded shapes, moldings, reinforced plastics, and foamed plastics.

FIG. 1 gives a breakdown of 1991 sales in the United States of solid carbonaceous plastics which are suitable feedstocks for the subject invention.

FIG. 1

| Material | Million lbs. 1991 |
|---|---|
| Acrylobutadienestyrene (ABS) | 1,125 |
| Acrylic | 672 |
| Alkyd | 315 |
| Cellulosic | 840 |
| Epoxy | 428 |
| Nylon | 536 |
| Phenolic | 2,556 |
| Polyacetal | 140 |
| Polycarbonate | 601 |
| Polyester, thermoplastic | 2,549 |
| Polyester, unsaturated | 1,081 |
| Polyethylene, high density | 9,193 |
| Polyethylene, low density | 12,143 |
| Polyphenylene-based alloys | 195 |
| Polypropylene and copolymers | 8,155 |
| Polystyrene | 4,877 |
| Other styrenes | 1,180 |
| Polyurethane | 2,985 |
| Polyvinylchloride and copolymers | 9,130 |
| Other vinyls | 120 |
| Styrene acrylonitrile (SAN) | 117 |
| Thermoplastic elastomers | 584 |
| Urea and melamine | 1,467 |
| Others | 345 |
| Total | 60,598 |

The solid carbonaceous plastic-containing material that contains associated inorganic matter e.g. filler or reinforcement material, has a higher heating value (HHV) in the range of about 3000 to 19,000 BTU per lb of solid carbonaceous plastic-containing material. The plastic-containing material is granulated by conventional means to a maximum particle dimension of about ¼", or less, such as about ⅛". Granulating is the preferred method for reducing the size of plastic. Any conventional plastic granulator and mill may be used. For example, the granulator will readily shred/grind solid plastic pieces to a particle size which passes through ASTM E11 Alternative Sieve Designation ¼" or less. A mill can take the product from the granulator (i.e., −¼") and readily convert it to smaller sizes (−⅛" or less), such as ASTM E11 Alternative Sieve Designation No. 7. For example, a suitable granulator and mill are made by Entoleter Inc., 251 Welton Street, Hamden, Conn. 06517. The ash content for an as-received granulated sample of solid carbonaceous plastic-containing material is in the range of about 5 to 70 wt. %. For example, the ash content of automotive crusher plastic residue (ACR) is 58.2 wt. %. The granulated solid carbonaceous plastic-containing material is mixed together with water to provide a plastic sludge having a solids content in the range of about 60 to 80 wt. % and having a minimum higher heating value (HHV) of about 2500 BTU/lb. of sludge.

The plastic sludge is preheated at a temperature in the range of about 350° F. to 475° F. in the absence of air in a closed system, for a residence time in the range of about 5 minutes to 1 hour. For example, the preheating may be done in a double tube heat exchanger or in a jacketed screw conveyor. The pressure is equal to the vapor pressure of water at the preheat temperature. Next, the preheated plastic sludge is hydrothermally treated in a closed vessel, such as an autoclave in the absence of air for a residence time in the range of about 15 to 90 minutes, such as 60 minutes, a pressure in the range of about 100 to 1200 psig, such as about 400 to 500 psig and a temperature in the range of about 450° F. to 650° F., such as about 500° F. to 550° F. In one embodiment, the preheating and hydrothermal treating steps are done in the same vessel, such as in an internally or externally heated conventional autoclave.

The supplemental water for producing the plastic sludge may be obtained from waste water streams produced in the partial oxidation system such as water used to cool the hot raw stream of synthesis gas. Other sources of water include refinery waste water, biochemical treatment plant for sewage sludge, and hazardous or carcinogenic producing water streams from chemical plants.

In another embodiment, a supplemental amount of ground solid carbonaceous fuel in admixture with the plastic sludge is preheated and hydrothermally treated together in the manner previously described. For example, from about 0.5 to 2 parts by wt. of solid carbonaceous fuel for each part by weight of plastic sludge may be ground together, preheated at a temperature in the range of about 350° F. to 475° F. and hydrothermally treated. Solid carbonaceous fuel includes by definition particulate carbon, coal, coke from coal, petroleum coke, oil shale, tar sands, asphalt, pitch, and mixtures thereof. Coal includes anthracite, bituminous, subbituminous and lignite. The solid carbonaceous fuel has a maximum particle size so that 100% passes through ASTM E 11-70 Standard Sieve Designation 2.8 mm (Alternative No. 7). The preheated mixture of plastic sludge and solid carbonaceous fuel is introduced into a closed autoclave and hydrothermally treated in the absence of air and at the same residence times, temperature and pressure ranges and above the vapor pressure of water at the temperature in the autoclave as previously described for the hydrothermal treatment of plastic sludge without the solid carbonaceous fuel. By the hydrothermal treatment of plastic sludge with or without admixture with solid carbonaceous fuel, the solid plastic sludge particles are rendered more slurryable by the changes in their structure and composition. Also, foam-containing plastic particles are converted into a more granular slurryable material. Hydrothermal treatment of coal particles, especially low rank coal, induces chemical changes in the coal structure by driving off oxygen-containing functional groups and thereby making a more slurryable material. Advantageously, the presence of coal particles in the plastic slurry during hydrothermal treatment prevents agglomeration of the plastic material and enhances the slurryability of the mixture. Further, when low rank coal is used, the low rank coal particles are upgraded to high rank coal, e.g., the energy density or heating value of the coal is upgraded.

After the hydrothermal treatment, the hydrothermally treated plastic sludge or the hydrothermally treated mixture of plastic sludge and solid carbonaceous fuel is cooled to a temperature in the range of about 100° F. to 200° F. At least one gas from the group consisting of $CO_2$, CO, $H_2S$, $NH_3$, and light hydrocarbon gases, e.g., $C_1$–$C_4$, is discharged from the autoclave. Preferably, the gas stream is sent to a conventional gas purification zone. For example, reference is made to coassigned U.S. Pat. No. 4,052,176, which is incorporated herein by reference.

The cooled hydrothermally treated plastic sludge or mixture of plastic sludge and solid carbonaceous fuel is then mixed with water and additional ground solid carbonaceous fuel having a maximum particle size so that 100% passes through ASTM E11-70 Standard Sieve Designation 2.8 mm (Alternative No. 7). A pumpable aqueous slurry is thereby produced having a solids content in the range of about 40 to 60 wt. % and a weight ratio of solid carbonaceous fuel to plastic sludge in the range of about 1 to 5 parts by wt. of solid carbonaceous fuel for each part by weight of plastic sludge.

The pumpable aqueous slurry of granulated solid carbonaceous plastic-containing material and solid carbonaceous fuel and a stream of free-oxygen containing gas are introduced into the reaction zone of a free-flow unobstructed downflowing vertical refractory lined steel wall pressure vessel where the partial oxidation reaction takes place for the production of raw synthesis gas, reducing gas, or fuel gas. A typical gas generator is shown and described in coassigned U.S. Pat. No. 3,544,291, which is incorporated herein by reference.

A two, three, or four stream annular type burner, such as shown and described in coassigned U.S. Pat. Nos. 3,847,564 and 4,525,175, which are incorporated herein by reference, may be used to introduce the feedstreams into the partial oxidation gas generator. With respect to U.S. Pat. No. 3,847,564, free-oxygen containing gas may be simultaneously passed through the central conduit 18 and outer annular passage 14 of said burner. The free-oxygen containing gas is selected from the group consisting of substantially pure oxygen i.e., greater than 95 mole % $O_2$, oxygen-enriched air i.e. greater than 21 mole % $O_2$, and air. The free-oxygen containing gas is applied at a temperature in the range of about 100° F. to 1000° F. The pumpable slurry of granulated solid carbonaceous plastic-containing material and solid carbonaceous fuel is passed into the reaction zone of the partial oxidation gas generator by way of the intermediate annular passage 16 at a temperature in the range of a about ambient to 650° F.

The burner assembly is inserted downward through a top inlet port of the noncatalytic synthesis gas generator. The burner extends along the central longitudinal axis of the gas generator with the downstream end discharging a multiphase mixture of fuel, free-oxygen containing gas, and temperature moderator directly into the reaction zone.

The relative proportions of fuels and free-oxygen containing gas in the feedstreams to the gas generator are carefully regulated to convert a substantial portion of the carbon in the slurry, e.g., up to about 90% or more by weight, to carbon oxides; and to maintain an autogenous reaction zone temperature in the range of about 1800° F. to 3500° F. Preferably the temperature in the gasifier is in the range of about 2400° F. to 2800° F., so that molten slag is produced. The pressure in the partial oxidation reaction zone is in the range of about 1 to 300 atmospheres. Further, the weight ratio of $H_2O$ to carbon in the feed is in the range of about 0.2–3.0 to 1.0, such as about 0.5–2.0 to 1.0. The atomic ratio of free-oxygen to carbon in the feed is in the range of about 0.8–1.5 to 1.0 such as about 0.9 to 1.2 to 1.0. By the aforesaid operating conditions, a reducing atmosphere comprising $H_2$+CO is produced in the reaction zone along with nontoxic slag.

The dwell time in the reaction zone of the gas generator is in the range of about 1 to 15 seconds, and preferably in the range of about 2 to 8 seconds. With substantially pure oxygen feed to the gas generator, the composition of the effluent gas from the gas generator in mole % dry basis may be as follows: $H_2$ 10 to 60, CO 20 to 60, $CO_2$ 5 to 60, $CH_4$ nil to 5, $H_2S$+COS nil to 5, $N_2$ nil to 5, and Ar nil to 1.5. With air feed to the gas generator, the composition of the generator effluent gas in mole % dry basis may be about as follows: $H_2$ 2 to 20, CO 5 to 35, $CO_2$ 5 to 25, $CH_4$ nil to 2, $H_2S$+COS nil to 3, $N_2$ 45 to 80, and Ar 0.5 to 1.5. Unconverted carbon, ash, or molten slag are contained in the effluent gas stream. Depending on the composition and use, the effluent gas stream is called synthesis gas, reducing gas, or fuel gas. For example, synthesis gas comprises mixtures of $H_2$+CO that can be used for chemical synthesis; reducing gas is rich in $H_2$+CO and is used in reducing reactions; and fuel gas comprises mixtures of $H_2$ +CO and may also include $CH_4$. Advantageously, in the extremely hot reducing atmosphere of the gasifier, the toxic elements in the inorganic matter in the solid carbonaceous plastic-containing material and solid carbonaceous are captured by the noncombustible constituents present and converted into nontoxic nonleachable slag. This permits the nontoxic slag to be sold as a useful by-product. For example, the cooled slag may be ground or crushed to a small particle size e.g. less than ⅛" and used in road beds or building blocks.

The hot gaseous effluent stream from the reaction zone of the synthesis gas generator is quickly cooled below the reaction temperature to a temperature in the range of about 250° F. to 700° F. by direct quenching in water, or by indirect heat exchange for example with water to produce steam in a gas cooler. The cooled gas stream may be cleaned and purified by conventional methods. For example, reference is made to coassigned U.S. Pat. No. 4,052,176 for removal of $H_2S$, COS, and $CO_2$. Advantageously, when gasifying plastics that contain halides such as polyvinylchloride, polytetrafluoroethylene, by partial oxidation, the halide is released as hydrogen halide (i.e. HCl, HF) and is scrubbed out of the synthesis gas with water containing ammonia or other basic materials. Plastics that contain bromine-containing fire retardants may be similarly treated. Reference is made to coassigned U.S. Pat. No. 4,468,376 which is incorporated herein by reference.

EXAMPLE

The following example illustrates the subject invention and should not be construed as limiting the scope of the invention.

Example 1

Four tons per day of a mixture comprising several types of plastic that are found in automobiles including unfilled, filled, and reinforced plastics from the following resins: polystyrene, polyamide, polyurethane, polyvinylchloride, polypropylene, and others are shredded to a particle dimension of less than about ⅛". The ultimate chemical analysis of the shredded mixture of plastics is shown in Table I. The chemical analysis of the ash in the mixture of plastics is shown in Table II.

TABLE I

Dry Analysis of Mixture of Plastics in Example 1

| | Weight Percent |
|---|---|
| C | 23.8 |
| H | 4.2 |
| N | 0.9 |
| S | 0.5 |
| O | 12.3 |

TABLE I-continued

| Dry Analysis of Mixture of Plastics in Example 1 | |
|---|---|
| | Weight Percent |
| Ash | 58.3 |

TABLE II

| Chemical Analysis of the Ash Present in the Mixture of Plastics in Example 1 | |
|---|---|
| | Wt. % |
| $SiO_2$ | 33.20 |
| $Al_2O_3$ | 6.31 |
| $Fe_2O_3$ | 22.00 |
| CaO | 29.20 |
| MgO | 0.94 |
| $Na_2O$ | 1.27 |
| $K_2O$ | 0.43 |
| $TiO_2$ | 0.89 |
| $P_2O_3$ | 0.92 |
| $Cr_2O_3$ | 0.28 |
| ZnO | 2.31 |
| PbO | 0.09 |
| BaO | 0.80 |
| CuO | 0.89 |
| NiO | 0.47 |

The granulated plastic is mixed with water to produce a plastic sludge having a solids content of about 70 wt. %. The plastic sludge is preheated for 30 minutes in a closed vessel in the absence of air at a temperature of about 450° F. Then, in a closed autoclave in the absence of air and at a temperature of 500° F. and a pressure of 800 psig and above the vapor pressure of water at that temperature, the preheated plastic sludge is hydrothermally treated for 30 minutes. The hydrothermally treated plastic sludge is cooled to 100° F. and a mixture of gases shown in Table III is separated from the plastic material and sent to a conventional gas purification zone.

TABLE III

| | VOLUME % |
|---|---|
| $CO_2$ | 80–99 |
| CO | <1.0 |
| $H_2S$ | <2.0 |
| $NH_3$ | <0.5 |
| $C_1$—$C_4$ | <1–20 |

The cooled hydrothermally treated plastic sludge is mixed with water and bituminous coal having a particle size so that 100% passes through ASTM E-11-70 (Standard Sieve Designation 2.8 mm (Alternative No. 7) to produce a pumpable slurry having a solids content of about 54 wt. % and a weight ratio of coal to plastic sludge of four parts by weight of coal for each part by weight of plastic sludge.

The pumpable slurry has a maximum viscosity of 1000 cP when measured at 160° F. and a higher heating value of 8500 BTU/lb.

The aqueous slurry is introduced into the reaction zone of a free-flow refractory lined vertical partial oxidation gas generator where it is reacted with 20 tons per day of oxygen gas by partial oxidation in a conventional free flow non-catalytic gas generator at a temperature of about 2400° F. and a pressure of about 500 psig. Synthesis gas comprising $H_2$+CO is produced along with about 4.6 tons of slag. Upon cooling, the slag is a coarse, glassy nonleachable material. If, however, the same mixture of plastics were fully combusted in air, the slag may contain toxic elements, e.g. chromium in a leachable form.

Other modifications and variations of the invention as hereinbefore set forth may be made without departing from the spirit and scope thereof, and, therefore, only such limitations should be imposed on the invention as are indicated in the appended claims.

We claim:

1. A partial oxidation process for the environmentally safe disposal of scrap plastic material containing inorganic filler or reinforcement material, comprising:

(1) grinding the plastic material;

(2) mixing the plastic from (1) with water to produce a sludge having a solids content in the range of about 60 to 80 wt. %;

(3) heating the sludge from (2) for a period in the range of about 5 minutes to 1 hour at a temperature in the range of about 350° F. to 475° F. in the absence of air in a closed system;

(4) hydrothermally treating the heated sludge from (3) in a closed vessel in the absence of air for a residence time in the range of about 15 to 90 minutes, a temperature in the range of about 450° F. to 680° F., a pressure in the range of about 100 to 1200 psig and above the vapor pressure of water at that temperature;

(5) cooling the hydrothermally treated sludge from (4) to a temperature in the range of about 100° F. to 200° F., and separating the gases generated from said sludge, said gases containing at least one member selected from the group consisting of $CO_2$, CO, $H_2S$, $NH_3$, and light hydrocarbon gases;

(6) mixing the cooled sludge from (5) with ground solid carbonaceous fuel and water to produce a pumpable aqueous slurry having a solids content in the range of about 40 to 60 wt. % and a weight ratio of solid carbonaceous fuel to said sludge in the range of about 1 to 5 parts by wt. of solid carbonaceous fuel for each part by weight of said sludge; and (7) reacting by partial oxidation with a free-oxygen containing gas said pumpable aqueous slurry from (6) to produce a gas containing $H_2$ and CO.

2. The process of claim 1 wherein steps 3 and 4 take place in the same vessel.

3. The process of claim 2 wherein said vessel is an autoclave.

4. The process of claim 1 wherein the plastic material in (1) is selected from the group consisting of polyesters, polyurethane, polyamide, polystyrene, polyvinylchloride, and polypropylene.

5. The process of claim 1 wherein from about 0.5 to 2.0 parts by weight of solid carbonaceous fuel are mixed with each part by weight of said sludge from (2) prior to preheating the mixture in ( 3 ) and hydrothermally treating the mixture in (4).

6. The process of claim 1 provided with the step of introducing the gas from (7) into a gas purification zone and removing gaseous impurities.

7. The process of claim 1 where in (1) said plastic material is ground to a particle size which passes through ASTM E11 Alternative Sieve Designation No. 7 or less.

8. The process of claim 1 where in (3) said preheating takes place for a period in the range of about 15 to 90 minutes.

9. The process of claim 1 where in (7) said pumpable aqueous slurry from (6) is reacted with a free-oxygen containing gas by partial oxidation in a free-flow refractory lined vertical gas generator at a temperature in the range of about 1800° F. to 3500° F. and a pressure in the range of about 1 to 300 atmospheres, an atomic ratio of O/C in the range of about 0.8–1.5 to 1.0, and a weight ratio of $H_2O$ to carbon in the range of about 0.2–3.0 to 1.0.

10. The process of claim 1 wherein said solid carbonaceous fuel is selected from the group consisting of particulate carbon, coal, coke from coal, petroleum coke, oil shale, tar sands, asphalt, pitch, and mixtures thereof.

11. The process of claim 1 where in (2) said water is obtained from waste water streams produced in the partial oxidation.

12. The process of claim 1 wherein (2) said water is obtained from refinery waste water, water from biochemical treatment plants for sewage sludge, and hazardous or carcinogenic producing water streams from chemical plants.

* * * * *